US009360811B2

(12) United States Patent
Bae et al.

(10) Patent No.: US 9,360,811 B2
(45) Date of Patent: Jun. 7, 2016

(54) IMAGE FIXING DEVICE AND IMAGE FORMING APPARATUS HAVING THE SAME

(71) Applicant: Samsung Electronics Co., Ltd, Suwon-si, Gyeonggi-do (KR)

(72) Inventors: Soo Hwan Bae, Seoul (KR); Dong Woo Lee, Seoul (KR); Ji Su Park, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/336,332

(22) Filed: Jul. 21, 2014

(65) Prior Publication Data

US 2015/0030362 A1 Jan. 29, 2015

(30) Foreign Application Priority Data

Jul. 29, 2013 (KR) ..... 10-2013-0089796

(51) Int. Cl.
*G03G 15/20* (2006.01)

(52) U.S. Cl.
CPC ..... *G03G 15/2085* (2013.01); *G03G 15/2053* (2013.01); *G03G 15/2064* (2013.01); *G03G 15/2089* (2013.01); *G03G 2215/2016* (2013.01); *G03G 2215/2032* (2013.01); *G03G 2215/2035* (2013.01)

(58) Field of Classification Search
CPC ..... G03G 15/20
USPC ..... 399/329
See application file for complete search history.

(56) References Cited

U.S. PATENT DOCUMENTS

| | | | | |
|---|---|---|---|---|
| 5,939,337 | A * | 8/1999 | Hatakeyama et al. | 442/6 |
| 6,456,819 | B1 * | 9/2002 | Abe et al. | 399/329 |
| 7,917,073 | B2 * | 3/2011 | Miyata et al. | 399/329 |
| 8,818,222 | B2 * | 8/2014 | Tamaki | 399/67 |
| 8,903,296 | B2 * | 12/2014 | Shimokawa et al. | 399/329 |
| 8,909,116 | B2 * | 12/2014 | Ohtsu | 399/329 |
| 8,929,791 | B2 * | 1/2015 | Ishii et al. | 399/329 |
| 9,075,359 | B2 * | 7/2015 | Soeda | |
| 2002/0168202 | A1 * | 11/2002 | Izawa et al. | 399/329 |
| 2003/0170054 | A1 * | 9/2003 | Suzuki et al. | 219/216 |

(Continued)

FOREIGN PATENT DOCUMENTS

| | | |
|---|---|---|
| JP | 2002-93565 | 3/2002 |
| JP | 2002-299007 | 10/2002 |

OTHER PUBLICATIONS

Extended European Search Report mailed Dec. 18, 2014 for corresponding European Patent Application No. 14171799.1.

*Primary Examiner* — Clayton E Laballe
*Assistant Examiner* — Kevin Butler
(74) *Attorney, Agent, or Firm* — Staas & Halsey LLP

(57) ABSTRACT

An image fixing device includes a heat source configured to generate heat, a fixing belt heated by the heat source and disposed to be rotatable, a rotational member disposed to be opposite to the fixing belt and to press a printing medium to the fixing belt, and a supporting member to support an inner circumferential surface of the fixing belt so as to form a fixing nip between the fixing belt and the rotational member and having a plurality of heat insulation grooves formed in a surface thereof so as to reduce thermal conductivity of the supporting member. By the configuration of the present general inventive concept, it is possible to prevent or minimize a heat loss of the fixing belt and thus to enhance image forming efficiency.

19 Claims, 7 Drawing Sheets

(56) References Cited

U.S. PATENT DOCUMENTS

| | | | | |
|---|---|---|---|---|
| 2007/0189818 | A1* | 8/2007 | Kondo et al. | 399/329 |
| 2009/0014942 | A1* | 1/2009 | Okuno | 271/4.06 |
| 2009/0304422 | A1* | 12/2009 | Takahashi | 399/329 |
| 2010/0092221 | A1* | 4/2010 | Shinshi et al. | 399/330 |
| 2011/0052282 | A1* | 3/2011 | Shinshi et al. | 399/329 |
| 2011/0222931 | A1* | 9/2011 | Shinshi et al. | 399/329 |
| 2012/0177420 | A1 | 7/2012 | Shimokawa et al. | |
| 2013/0034374 | A1* | 2/2013 | Ohtsu et al. | 399/329 |
| 2013/0216282 | A1* | 8/2013 | Ohtsu | 399/329 |
| 2014/0086651 | A1* | 3/2014 | Otsu | 399/331 |
| 2014/0205332 | A1* | 7/2014 | Otsu | 399/329 |

* cited by examiner

IMAGE FIXING DEVICE AND IMAGE FORMING APPARATUS HAVING THE SAME

CROSS-REFERENCE TO RELATED APPLICATIONS

This application claims the benefit of priority under 35 U.S.C. §119 from Korean Patent Application No. 10-2013-0089796, filed on Jul. 29, 2013 in the Korean Intellectual Property Office, the disclosure of which is incorporated herein by reference.

BACKGROUND OF THE INVENTION

1. Field of the Invention

Embodiments of the present general inventive concept relate to an image fixing device and an image forming apparatus having the same.

2. Description of the Related Art

In general, an image forming apparatus is a device to print an image on a printing medium. An image forming apparatus, may be, for example, a printer, a copy machine, a fax machine, or an all-in-one printer in which various functions thereof are incorporated, and so forth.

In an electro-photographic type image forming apparatus, light is scanned on a photoreceptor charged with a predetermined potential in order to form an electrostatic latent image on a surface of the photoreceptor. A toner is supplied to the electrostatic latent image in order to form a visible image. The visible image formed on the photoreceptor may be directly transferred to the printing medium, or may be transferred to the printing medium through an intermediate transfer, and then may be fixed on the printing medium while passing through an image fixing device.

In general, the image fixing device includes a fixing belt, including a roller, a belt, or the like, and a rotational member which is in close contact with the fixing belt and forms a fixing nip. If a printing medium on which a toner image is transferred enters between the fixing belt and the rotational member, the toner image is fixed on the printing medium by heat transferred from a heating member and pressure applied from the fixing nip. An internal member is provided in the fixing belt so as to support an inside of the fixing belt and thus to form a nip between the rotational member and the internal member.

In this case, heat transferred to the fixing belt through a heat source is transferred to the internal member, and thus heat transfer efficiency is deteriorated.

SUMMARY OF THE INVENTION

Therefore, it is a feature of the present general inventive concept to provide an image fixing device which employs a heat insulation structure so as to improve a heating performance and also to reduce power consumption, and an image forming apparatus having the same.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an image fixing device including a heat source configured to generate heat, a fixing belt heated by the heat source and disposed to be rotatable, a rotational member disposed to be opposite to the fixing belt and to press a printing medium to the fixing belt, and a supporting member to support an inner circumferential surface of the fixing belt so as to form a fixing nip between the fixing belt and the rotational member and having a plurality of heat insulation grooves formed in a surface thereof so as to reduce thermal conductivity of the supporting member.

The supporting member may include a first surface which is formed toward the rotational member, and a second surface which is opposite to the first surface, and the plurality of heat insulation grooves may be provided in one of the first and second surfaces.

The plurality of heat insulation grooves may be formed in the first surface so as to be in contact with the inner circumferential surface of the fixing belt.

The image fixing device may further include a pressure member disposed in the fixing belt so as to press the second surface, and the plurality of heat insulation grooves may be formed in the second surface so as to be in contact with the pressure member.

The image fixing device may further include a subsidiary supporting member provided between the supporting member and the fixing belt so as to reduce friction of the supporting member.

The plurality of heat insulation grooves may be formed in the first surface so as to be in contact with an inner surface of the subsidiary supporting member.

The plurality of heat insulation grooves may be provided so as to reduce the thermal conductivity from the fixing belt to the pressure member.

The plurality of heat insulation grooves may include a lower heat insulation groove formed in the first surface, and an upper heat insulation groove formed in the second surface.

The upper heat insulation groove and the lower heat insulation groove may be disposed to be offset from each other.

The supporting member may be disposed in a first direction which is a movement direction of the printing medium and a second direction which is perpendicular to the first direction, and the heat insulation grooves may be arranged in a plurality of lines in the second direction.

The heat insulation grooves in one of the plurality of lines may be disposed to be offset from the heat insulation grooves in another adjacent line.

The heat insulation grooves in one of the plurality of lines may be provided to partially overlap the heat insulation grooves in another adjacent line in the second direction.

Each of the plurality of heat insulation grooves may have one of a circular shape and a polygonal shape.

The supporting member may further include a guide part which is bent from front and rear ends thereof with respect to a movement direction of the printing medium so as to guide the pressure member.

The present general inventive concept may also provide an image forming apparatus including an image fixing device which is configured to apply heat and pressure to a printing medium passing through a fixing nip and thus to fix a non-fixed image on the printing medium, the image fixing device including a heat source configured to generate heat, a fixing belt heated by the heat source and disposed to be in contact with a surface of the printing medium having a non-fixed image and to transfer heat thereto, a rotational member disposed to be in pressure contact with an outer circumferential surface of the fixing belt, a pressure member disposed in the fixing belt to press the fixing belt to the rotational member, and a supporting member pressed by the pressure member so as to form the fixing nip between the fixing belt and the rotational member and to support an inner circumferential surface of the fixing belt, the supporting member including a supporting surface to support the pressure member and the inner circumferential surface of the fixing belt, and a plurality of heat insulation grooves which are formed to be relatively more concave than the supporting surface.

The plurality of heat insulation grooves may be alternately disposed so that at least one of the plurality of heat insulation grooves corresponds to a movement direction of the printing medium.

The supporting surface may include a first surface supporting the inner circumferential surface of fixing belt, and a second surface pressed by the pressure member, and the plurality of heat insulation grooves may be formed in at least one of the first and second surfaces.

The plurality of heat insulation grooves may include a lower heat insulation groove formed in the first surface, and an upper heat insulation groove formed in the second surface.

The plurality of heat insulation grooves may be uniformly distributed in the supporting surface.

The plurality of heat insulation grooves may have a first surface area or less, such that the fixing belt is prevented from being pressed by the rotational member and thus inserted into the heat insulation grooves.

The present general inventive concept may also provide an image fixing device including a fixing belt disposed to be rotatable, a rotational member disposed to pressure an outer circumferential surface of the fixing belt, a supporting member to support an inner circumferential surface of the fixing belt so as to form a fixing nip between the fixing belt and the rotational member, and a pressure member to press the supporting member to the fixing belt, wherein the supporting member includes a base part disposed in the fixing belt in a length direction of the fixing belt, and a plate insulation part to reduce thermal conductivity of the supporting member and comprising a nip forming part extending and protruding from the base part so as to form the fixing nip, and a plurality of heat insulation grooves formed in the nip forming part to receive air.

The present general inventive concept may also provide a fixing belt to fix toner to a print medium, a rotational member disposed to be opposite to the fixing belt and to press a printing medium to the fixing belt, a heat source to heat the fixing belt, a pressure member to apply pressure to a surface of the fixing belt to form a fixing nip between the fixing belt and the rotational member, and a heat blocking member disposed between the heat source and the pressure member to block heat from the heat source from being radiated to the pressure member.

The heat blocking member may include a reflecting layer on a facing the heat source in order to reflect heat to the fixing belt.

The heat blocking member may be formed of a material having a higher thermal conductivity than a thermal conductivity of the pressure member.

The image fixing device may include a nip forming unit disposed between the fixing belt and the pressure member to space the fixing belt and the pressure member apart.

The image fixing device may include a subsidiary supporting member disposed between the nip forming unit and the fixing belt to enhance a heat insulation effect of the nip forming unit. The subsidiary supporting member may have a surface finish to reduce friction between the nip forming unit and the fixing belt.

The nip forming unit may be formed of a material having a lower thermal conductivity than a thermal conductivity of the subsidiary supporting member.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
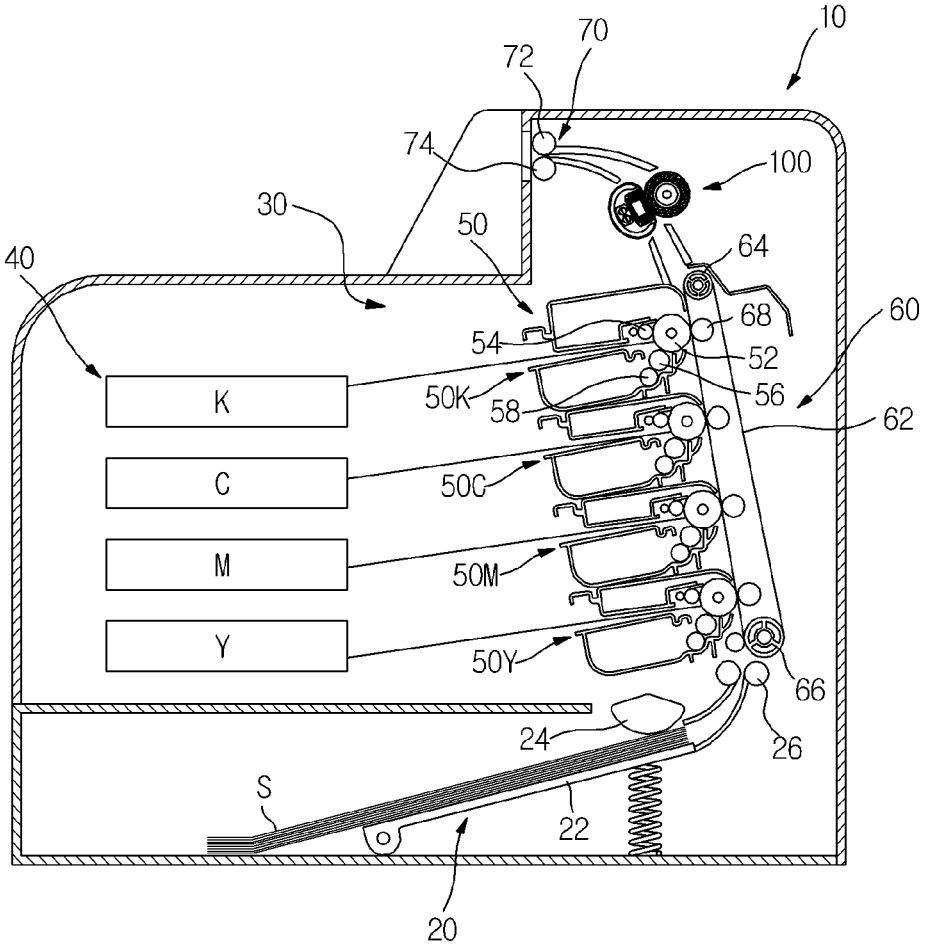
FIG. 1 is a view of an image forming apparatus in accordance with an exemplary embodiment of the present general inventive concept.

Reference will now be made in detail to the embodiments of the present general inventive concept, examples of which are illustrated in the accompanying drawings, wherein like reference numerals refer to like elements throughout the detailed description. The embodiments are described below in order to explain the present general inventive concept while referring to the figures.

The matters defined in the description, such as detailed construction and elements, are provided to assist in a comprehensive understanding of the exemplary embodiments. Thus, it is apparent that the exemplary embodiments can be carried out without those specifically defined matters. Also, functions or elements known in the related art are not described in detail since they would obscure the exemplary embodiments with unnecessary detail.

FIG. 1 illustrates an image forming apparatus in accordance with one embodiment of the present general inventive concept.

As illustrated in FIG. 1, an image forming apparatus 1 includes a main body 10, a printing medium supplying device 20, a printing device 30, an image fixing device 100, and a printing medium discharging device 70.

The main body 10 serves to form an external appearance of the image forming apparatus and also to support various components installed therein. The main body 10 includes a cover (not illustrated) which is provided to open and close a part of the main body 10, and a main body frame (not illustrated) which supports or fixes the various components in the main body 10.

The printing medium supplying device 20 serves to supply a printing medium S to the printing device 30. The printing medium supplying device 20 includes a tray 22 in which the printing medium S is loaded, and a pick-up roller 24 which picks up the printing medium, one sheet at a time, which is loaded in the tray 22. The printing medium picked up by the pick-up roller 24 is transported to the printing device 30 by a transport roller 26.

The printing device 30 may include a light scanning device 40, a developing device 50, and a transferring device 60.

The light scanning device 40 includes an optical system (not illustrated) and serves to scan light corresponding to image information of a yellow color Y, a magenta color M, a cyan color C, and a black color K to the developing device 50 according to a printing signal.

The developing device 50 forms a toner image according to the image information input from an external apparatus, such as, for example, a computer. In the embodiment, the image forming apparatus 1 is a color image forming apparatus, and the developing device 50 includes 4 developers 50Y, 50M, 50C, and 50K in which each toner of the yellow color Y, the magenta color M, the cyan color C, and the black color K is received. However, the present general inventive concept is not limited thereto. Developing device 50 may comprise different color toners or may provide black color toner only for printing black and white images.

Each of the developers 50Y, 50M, 50C, and 50K may include a photoreceptor 52 having an electrostatic latent image formed on a surface thereof by the light scanning device 40, a charge roller 54 charging the photoreceptor 52, a developing roller 56 providing the toner image to the electrostatic latent image formed on the photoreceptor 52, and a supplying roller 58 supplying the toner to the developing roller 56.

The transferring device 60 serves to transfer the toner image formed on the photoreceptor 52 to the printing medium. The transferring device 60 may include a transfer belt 62 which is in contact with each photoreceptor 52 and performs a track circulation, a driving roller 64 which drives the transfer belt 62, a tension roller 66 which maintains a tension of the transfer belt 62, and four transfer rollers 68 which transfer the toner image developed on the photoreceptor 52 to the printing medium.

The printing medium is attached to the transfer belt 62 and thus transported at the same speed as that of the transfer belt 62. A voltage having an opposite polarity to that of the toner attached to each photoreceptor 52 is applied to each of the transfer rollers 68, and thus the toner image on the photoreceptor 52 is transferred to the printing medium.

The image fixing device 100 serves to fix the toner image transferred to the printing medium by the transferring device 60 to the printed medium. Description of the image fixing device 100 will be described later.

Meanwhile, the printing medium discharging device 70 serves to discharge the printing medium to an outside of the main body 10. The printing medium discharging device 70 includes a discharging roller 72 and a pinch roller 74 disposed to be opposite to the discharging roller 72.

Figure 2:
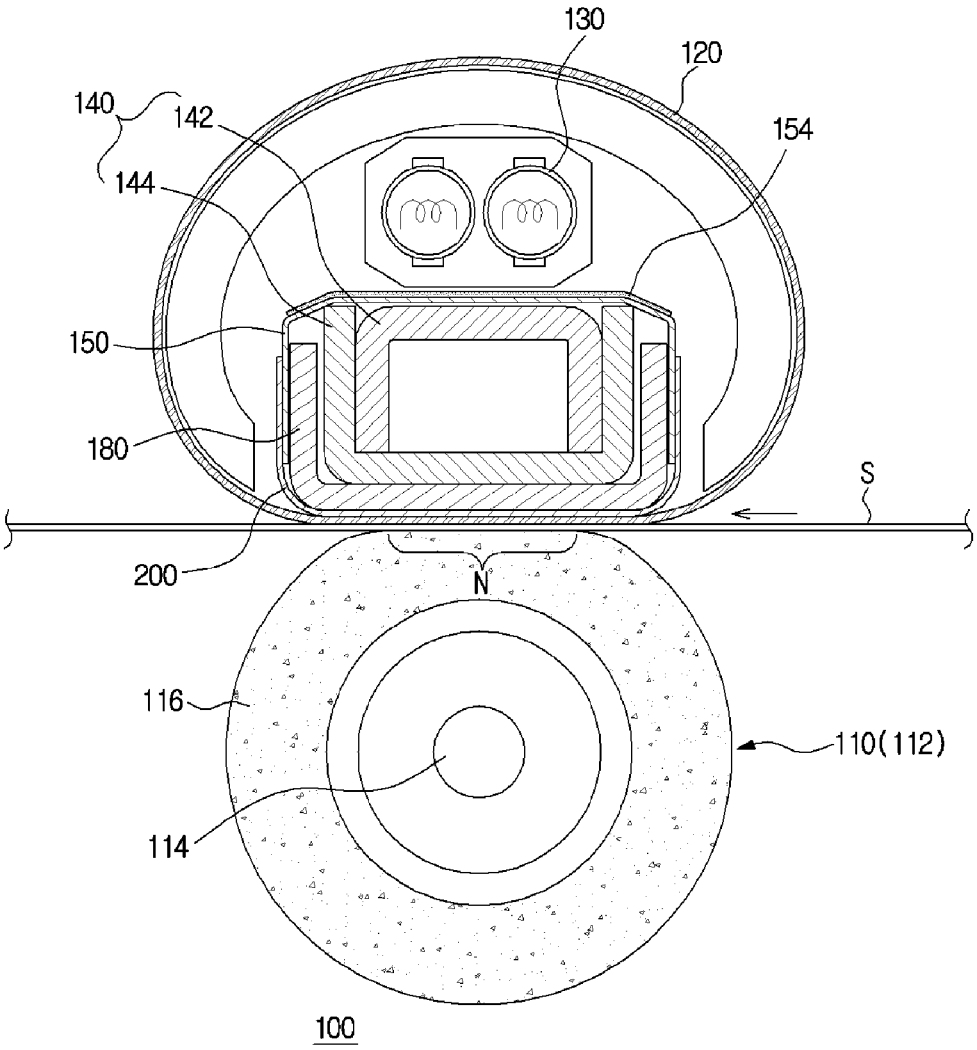
FIG. 2 is a cross-sectional view of an image fixing device in accordance with an exemplary embodiment of the present general inventive concept.
Figure 3:
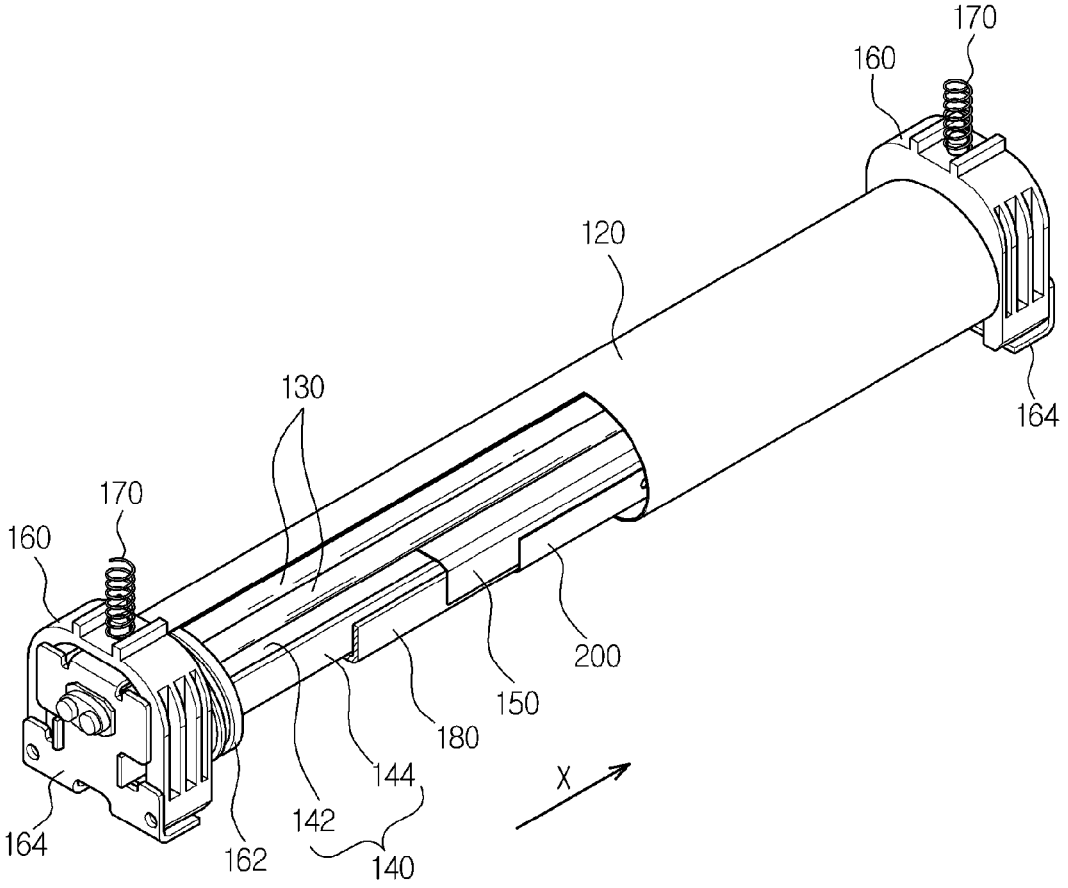
FIG. 3 is a partially cross-sectional view of the image fixing device in accordance with an exemplary embodiment of the present general inventive concept.
Figure 4:
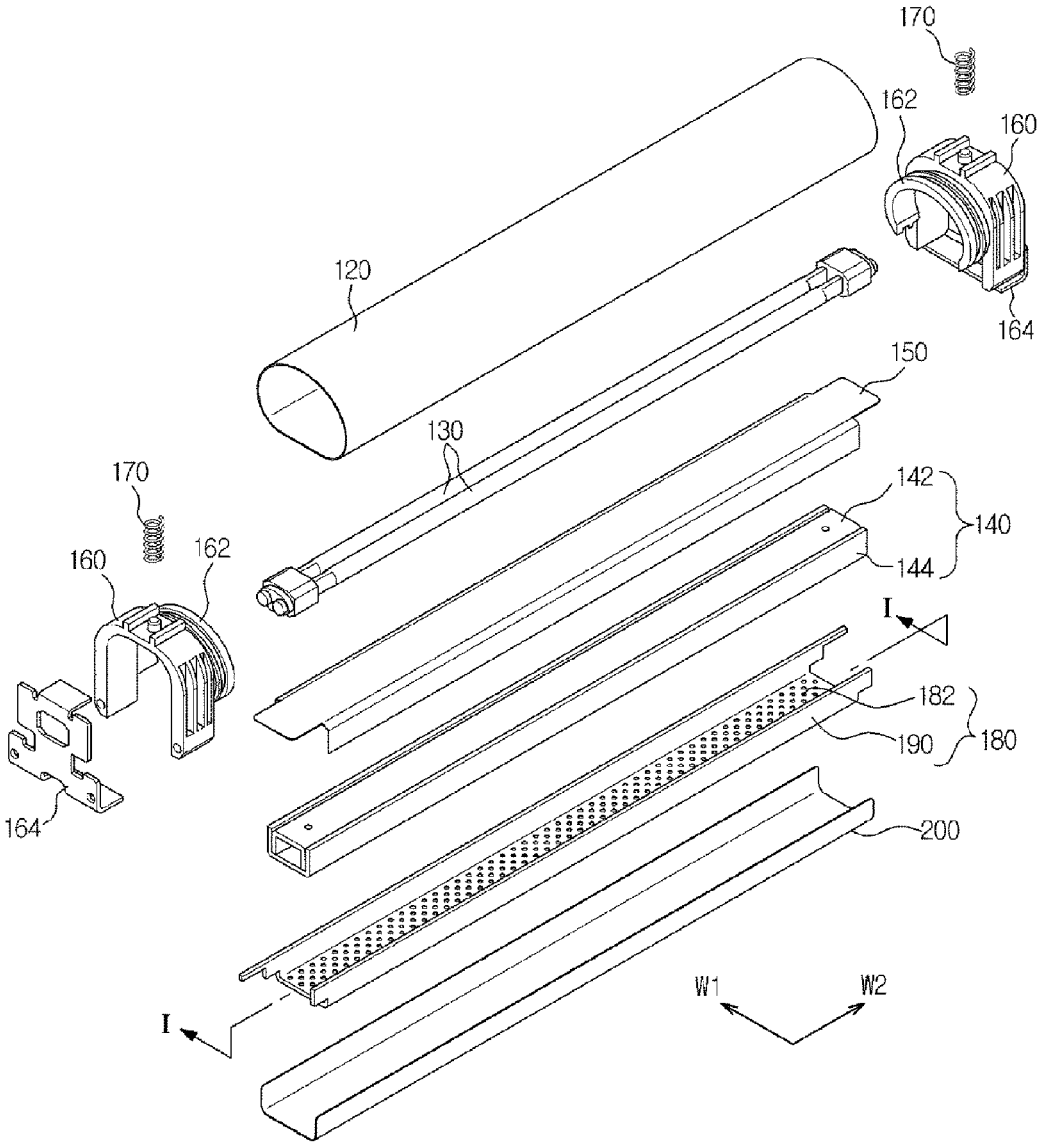
FIG. 4 is an exploded view of the image fixing device in accordance with an exemplary embodiment of the present general inventive concept.

FIG. 2 illustrates a cross-sectional view of an image fixing device in accordance with one embodiment of the present general inventive concept, FIG. 3 illustrates a partially cross-sectional view of the image fixing device in accordance with one embodiment of the present general inventive concept, and FIG. 4 illustrates an exploded view of the image fixing device in accordance with one embodiment of the present general inventive concept.

Hereinafter, it is defined that a width direction of the printing medium S, a width direction of a rotational member 110, a width direction of a pressure member 140, and a width direction of a nip forming unit 180 mean the same direction (X) as illustrated in FIG. 3.

As illustrated in FIGS. 2 to 4, the image fixing device 100 includes the rotational member 110, a fixing belt 120, a heat source 130, the pressure member 140, a heat blocking member 150, the nip forming unit 180, and a subsidiary supporting member 200.

The printing medium S to which the toner image is transferred passes through between the rotational member 110 and the fixing belt 120. At this time, the toner image is fixed to the printing medium by heat and pressure.

The rotational member 110 is disposed to be in contact with an outer circumferential surface of the fixing belt 120 and forms a fixing nip N between the fixing belt 120 and the rotational member 110. The rotational member 110 may be configured with a fixing roller 112 which receives driving power from a driving source (not illustrated) so as to be rotated.

The fixing roller 112 includes a shaft 114 formed of a metallic material such as aluminum and steel, and an elastic layer 116 which is elastically deformed and forms the fixing nip N between the fixing belt 120 and the elastic layer 116. The elastic layer 116 may be formed of a material having elastic properties, for example, silicon rubber. The elastic layer 116 may have a hardness of 50 or more and 80 or less in ASKER-C hardness and a thickness of 3 mm or more and 6 mm or less, such that a high fixing pressure in the fixing nip N is applied to the printing medium S. A release layer (not illustrated) preventing the printing medium S from being adhered to the fixing roller 112 may be provided on a surface of the elastic layer 116.

The fixing belt 120 is rotated in a state of being engaged with the fixing roller 112, forms the fixing nip N together with the fixing roller 112, is heated by the heat source 130, and transfers heat to the printing medium S passing through the fixing nip N. The fixing belt 120 may be formed into a single layer formed of, for example, a metal or a heat-resistant polymer, or a basic layer formed of the metal or the heat-resistant polymer, to which an elastic layer and a protective layer are added. An inner surface of the fixing belt 120 may be colored or coated with a black color in order to promote heat absorption.

The heat source 130 is disposed so as to directly radiant-heat at least a part of an inner circumferential surface of the fixing belt 120. At least two or more heat sources 130 may be provided to enhance an image fixing performance. A halogen lamp may be used for the heat source 130, and an electric heating wire, a planar heating element, or the like other than the halogen lamp may be also used.

Supporting members 160 are disposed at both sides of the fixing belt 120. The supporting members 160 serve to support construction components of the image fixing device 100. The fixing belt 120 may be rotatably supported by the supporting members 160. Each of the supporting members 160 may include a belt supporting part 162 which protrudes toward the fixing belt 120 so as to support an end of the fixing belt 120.

The supporting members 160 are respectively pressed toward the rotational member 110 by an elastic member 170. One end of the elastic member 170 is supported to an upper portion of the supporting member 160, and the other end thereof is supported to a separate frame.

A holder 164 is coupled to the supporting member 160. The holder 164 is disposed at an outer side of the supporting member 160 so as to support an end of the heat source 130 and an end of the pressure member 140. A pressure force applied to the supporting member 160 is transmitted to the pressure member 140 through the holder 164, and thus the pressure member 140 is pressed toward the rotational member 110.

The pressure member 140 applies a pressure to the inner circumferential surface of the fixing belt 120 so as to form the fixing nip N between the fixing belt 120 and the rotational member 110. The pressure member 140 may be formed of a material having an strength so as to minimize deformation, such as, for example, stainless and carbon steel.

If the pressure member 140 has a strength less than a predetermined value to minimize deformation, a bending deformation may occur in the pressure member 140, and thus the pressure member 140 may not uniformly press the fixing nip N. Therefore, in order to reduce the bending deformation, the pressure member 140 includes a first pressure member 142 having an arch-shaped cross-section and a second pressure member 144 having a reversed arch-shaped cross-section. The first and second pressure members 142 and 144 are coupled with each other so that at least a part of the first pressure member 142 is received in the second pressure member 144. The pressure member 140 may be formed into a structure having a large cross-sectional inertia moment, such as, for example, an I-beam type, an H-beam type, and the like other than the arch shape and the reversed arch shape.

If the radiant heat of the heat source 130 directly heats the pressure member 140, the pressure member 140 may be heated to a high temperature and thermally deformed, and thus the pressure member 140 may not uniformly press the fixing nip N. Further, if most of the heat radiated from the heat source 130 is used for heating the pressure member 140, a heating performance of the image fixing device 100 may be deteriorated.

Therefore, the image fixing device 100 includes the heat blocking member 150 disposed between the heat source 130 and the pressure member 140. The heat blocking member 150 is disposed to enclose at least a part of the pressure member 140, particularly an upper portion of the pressure member 140 opposite to the heat source 130, so as to block the heat from being directly radiated to the pressure member 140, thereby preventing or minimizing the pressure member 140 from being thermally deformed.

The heat blocking member 150 may include a reflecting layer 154 reflecting the heat of the heat source 130. The reflecting layer 154 may be provided on a surface of the heat blocking member 150 opposite to the heat source 130. The reflecting layer 154 may be formed by coating the heat blocking member 150 with a reflecting material such as silver. As described above, if the reflecting layer 154 is formed at the heat blocking member 150, the heat radiated to the heat blocking member 150 is reflected to the fixing belt 120, and thus promotes the heating of the fixing belt 120.

The heat blocking member 150 may be formed of a material having a good thermal conductivity. The heat blocking member 150 may be formed of a material having a higher thermal conductivity than that of the pressure member 140. For example, the heat blocking member 150 may be formed of aluminum, copper, or an alloy thereof.

Figure 5:
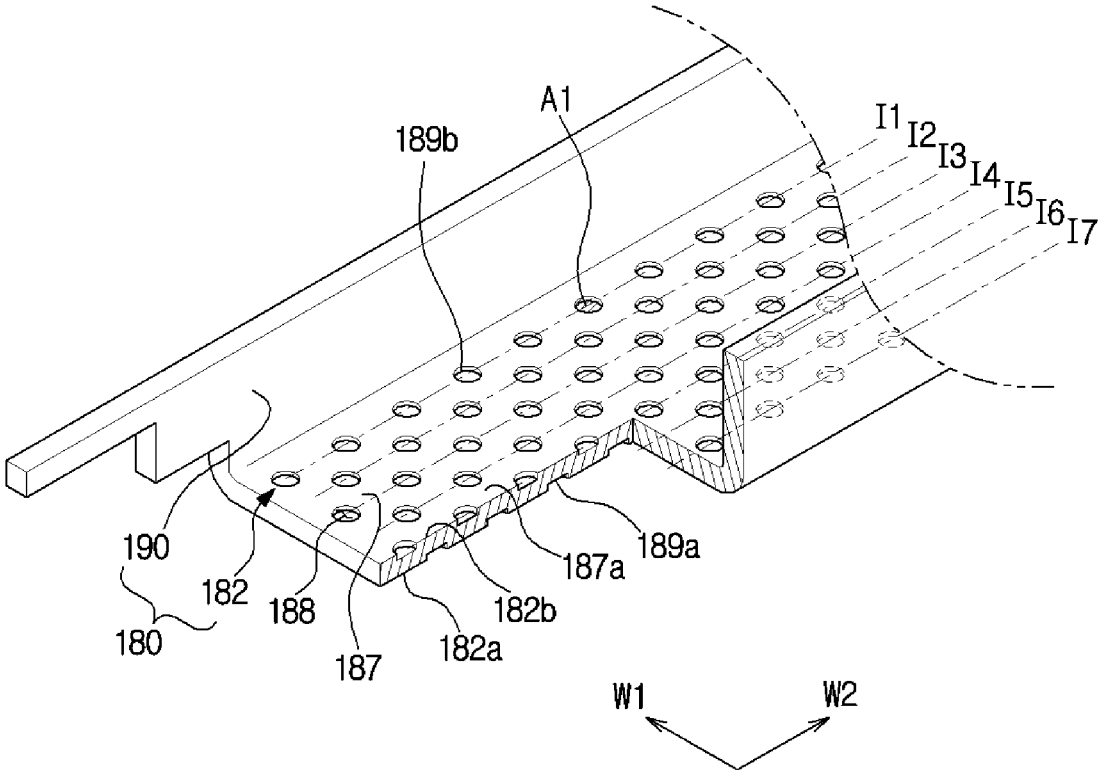
FIG. 5 is a partially cross-sectional view of a nip forming unit in accordance with an exemplary embodiment of the present general inventive concept.
Figure 6:
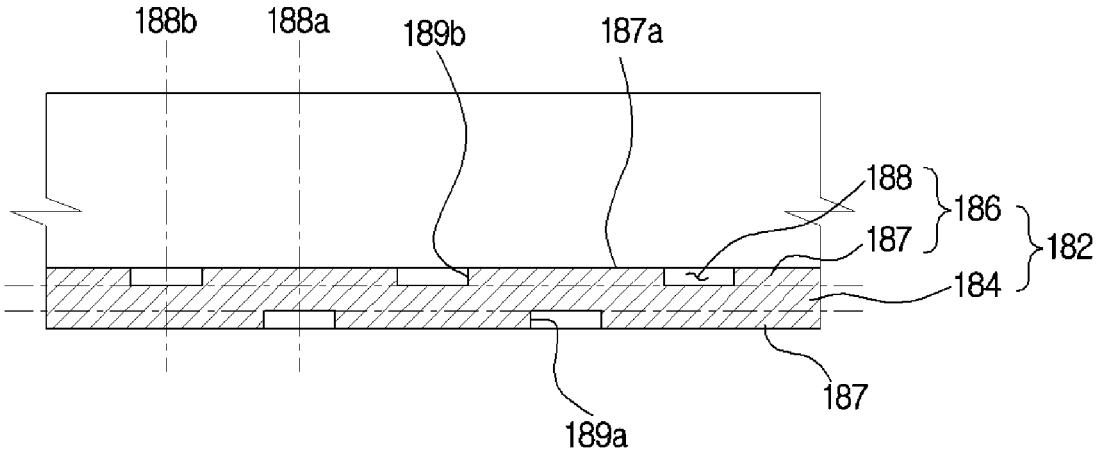
FIG. 6 is a cross-sectional view of the nip forming unit in accordance with an exemplary embodiment of the present general inventive concept.

FIG. 5 illustrates a partially cross-sectional view of the nip forming unit 180 in accordance with an exemplary embodiment of the present general inventive concept, and FIG. 6 illustrates a cross-sectional view of the nip forming unit 180 in accordance with an exemplary embodiment of the present general inventive concept.

The nip forming unit 180 is disposed in the fixing belt 120, and may include a supporting member 182 and a guide part 190.

The nip forming unit 180 has a reversed arch-shaped cross-section, and serves to space the fixing belt 120 and the pressure member 140 apart so that the heat of the fixing belt 120 is not transferred to the pressure member 140. The nip forming unit 180 is formed of a material having a low thermal conductivity and a thermal resistance. The nip forming unit 180 may be formed of a material having a lower thermal conductivity than that of the subsidiary supporting member 200. For example, the nip forming unit 180 may be formed of a high polymer, a ceramic material or a thermal resistant resin such as Polyether Ether Ketones (PEEK) and Liquid Crystal Polymer (LCP).

The supporting member 182 supports the inner circumferential surface of the fixing belt 120 so as to form the fixing nip between the fixing belt 120 and the rotational member 110. The supporting member 182 may have a plurality of heat insulation grooves 188 arranged in a surface thereof so as to reduce the thermal conductivity.

The supporting member 182 may be formed along a length direction of the fixing belt 120 so as to support the inner circumferential surface of the fixing belt 120.

The supporting member 182 may have the plurality of heat insulation grooves 188 formed in the surface thereof and may support the inner circumferential surface of the fixing belt 120. The supporting member 182 is pressed by the pressure member 140 and forms the fixing nip N between the fixing belt 120 and the rotational member 110.

The supporting member 182 may include a base part 184 and a plate insulation part 186.

The base part 184 is disposed inside the fixing belt 120 in the length direction. The plate insulation part 186 to be described below may be disposed on an outer surface of the base part 184.

The plate insulation part 186 provided on the outer surface of the base part 184 may cooperate with the base part 184 so as to prevent the heat of the fixing belt 120 from being transferred to the pressure member 140 and also may support the inner circumferential surface of the fixing belt 120 so as to form the fixing nip N.

The plate insulation part 186 which is an element of the supporting member 182 serves to reduce or block the heat transferred from the fixing belt 120 to the pressure member 140. Therefore, the pressure member 140 is prevented from being heated and thus a pressing ability of the pressure member 140 to the fixing belt 120 is prevented from being reduced.

Further, by a heat insulation function of the plate insulation part 186, the heat of the fixing belt 120 is transferred to the fixing nip N, not into the fixing belt 120, and thus a heating performance of the fixing nip N is enhanced. Therefore, power consumption is reduced, and fixedness with respect to the printing medium S is also increased.

The plate insulation part 186 may include a nip forming part 187 and the heat insulation grooves 188.

The nip forming part 187 may be formed of a high heat-resistant high polymer and have a thermal conductivity of 0.2 to 0.8 W/mk, and air in the heat insulation grooves 188 may have a thermal conductivity of 0.025 to 0.035 W/mk. Therefore, the nip forming part 187 and the air in the heat insulation grooves 188 may have a total thermal conductivity of 0.11 to 0.41 W/mk, and thus about 45% of the thermal conductivity may be reduced compared to a case that only the single nip forming part 187 is provided.

The nip forming part 187 extends and protrudes from the base part 184 so as to form the fixing nip N.

A pressure surface 187*a* supporting the inner circumferential surface of the fixing belt 120 may be provided at an end of the nip forming part 187. The pressure surface 187*a* may be provided so as to directly support the inner circumferential surface of the fixing belt 120, or may be provided so as to support an inner surface of the subsidiary supporting member 200.

The heat insulation grooves 188 may be formed to be relatively more concave than the pressure surface 187*a*, such that the air is maintained in the heat insulation grooves 188. Since the air is maintained in the heat insulation grooves 188, the entire thermal conductivity may be reduced compared to the case that only the single nip forming part 187 is provided, as described above. Specifically, the heat insulation grooves 188 may be provided to reduce the thermal conductivity from the fixing belt 120 corresponding to the fixing nip to the pressure member 140.

The supporting member 182 may include a first surface 182*a* which is formed toward the rotational member 110, and a second surface 182*b* which is opposite to the first surface 182*a* and formed toward the pressure member 140. The heat insulation grooves 188 may be formed in at least one of the first and second surfaces 182*a* and 182*b*.

That is, a heat insulation structure in which the heat insulation grooves 188 are formed in the both upper and lower surfaces (second surface 182*b* and first surface 182*a*, respectively) may be provided, or another heat insulation structure in which the heat insulation grooves 188 are formed in only one of the surfaces may be provided.

Specifically, the plurality of heat insulation grooves may be formed in the first surface 182*a* so as to be in contact with the inner circumferential surface of the fixing belt 120. Further, the plurality of heat insulation grooves may be formed in the second surface 182*b* so as to be in contact with the pressure member 140.

Hereinafter, arrangement and configuration in the case that the heat insulation grooves 188 are provided in both of the first and second surfaces 182*a* and 182*b* will be described.

When the heat insulation grooves 188 are formed in both of the first and second surfaces 182*a* and 182*b*, the heat insulation grooves 188 may be arranged so that a lower imaginary line 188*a* and an upper imaginary line 188*b* coincide with each other, i.e., arrangements of the heat insulation grooves 188 in the first surface 182*a* and the heat insulation grooves 188 in the second surface 182*b* are symmetrical with respect to the base part 184.

Alternatively, as in exemplary the embodiment of the present general inventive concept illustrated in FIG. 6, the lower imaginary line 188*a* passing through a center of the heat insulation grooves 188 in the first surface 182*a* and the upper imaginary line 188*b* passing through a center of the heat insulation grooves 188 in the second surface 182*b* may be arranged to be spaced apart from each other. In this configuration, the heat insulation grooves 188 formed in each of the first and second surfaces 182*a* and 182*b* are not arranged on the same line, and thus an interaction of the heat insulation grooves 188 formed in each of the first and second surfaces 182*a* and 182*b* may be reduced.

An exemplary layout of the plurality of heat insulation grooves 188 formed in the first and second surfaces 182*a* and 182*b* will be further described as follows.

The plurality of heat insulation grooves 188 may include a lower heat insulation groove 189*a* formed in the first surface 182*a* and an upper heat insulation groove 189*b* formed in the second surface 182*b*. The lower heat insulation groove 189*a* and the upper heat insulation groove 189*b* may be arranged to be offset.

In other words, the lower heat insulation groove 189*a* and the upper heat insulation groove 189*b* may be arranged to not be directly opposite to each other, that is, arranged to be spaced apart from each other, and thus the interaction of the heat insulation grooves 188 may be minimized.

Specifically, the lower heat insulation groove 189*a* and the upper heat insulation groove 189*b* may be offset in a first direction W1 which is a movement direction of the printing medium, or may be offset in a second direction W2 which is perpendicular to the first direction W1. Further, the heat insulation grooves 188 may be arranged to be offset at an angle which is formed between the first and second directions W1 and W2.

Hereinafter, arrangement and configuration in the case that the heat insulation grooves 188 are provided in one of the first and second surfaces 182*a* and 182*b* will be described. For convenience of explanation, the heat insulation grooves 188 are arranged in the first surface 182*a*. However, the heat insulation grooves 188 may be arranged in the second surface 182*b*.

The plurality of heat insulation grooves 188 may be provided to be uniformly distributed in the supporting member 182.

The heat insulation grooves 188 may be uniformly provided to have the same distance therebetween. Furthermore, the heat insulation grooves 188 may be alternately formed in the supporting member 182.

Specifically, the plurality of heat insulation grooves 188 may be provided in the supporting member 182 to be spaced apart from each other along a plurality of imaginary lines 11, 12, and 13 which are parallel with each other, for example, in a width (W2) direction, and the heat insulation grooves 188 on one of the imaginary lines and the heat insulation grooves 188 on another of the imaginary lines may be provided to alternate with each other in a checkerboard pattern. In FIG. 5, three of the illustrated imaginary lines 11, 12, and 13 are presently referred to for convenience of explanation, but the number of the imaginary lines is not limited thereto.

That is, the heat insulation grooves 188 may be arranged in an alternate direction with respect to the movement direction of the printing medium S so that the printing medium S may pass through a portion of the fixing belt 120 corresponding to the heat insulation grooves 188.

As described above, the heat insulation grooves 188 may be uniformly provided to have the same distance therebetween. However, in this configuration, since the nip forming part 187 is not uniformly arranged with respect to the movement direction of the printing medium S, only a certain section is further heated. Since the fixing belt 120 in this section loses heat to the nip forming part 187 and thus has a low temperature, the printing medium may be not printed uniformly.

Therefore, the heat insulation grooves 188 are alternately provided, as described above, and thus the nip forming part 187 supporting the inner circumferential surface of the fixing belt 120 may be uniformly provided with respect to the movement direction of the printing medium S.

Further arrangement and configuration of the heat insulation grooves 188 will be described below.

The supporting member 160 may have a first direction W1 which is a movement direction of the printing medium and a second direction W2 which is perpendicular to the first direction W1. The heat insulation grooves 188 may be arranged in a plurality of lines in the second direction W2. In FIG. 5, seven imaginary lines 11 to 17 have been illustrated, but the number of the imaginary lines is not limited thereto.

The heat insulation grooves 188 provided along one of the plurality of lines may be arranged to be offset from the heat insulation grooves 188 provided along another line adjacent thereto. Although it is illustrated that the heat insulation grooves 188 provided along one of the lines are arranged between the heat insulation grooves 188 provided along the other line adjacent thereto, a degree of the offset is not limited thereto. The heat insulation grooves 188 may be arranged in the first direction W1 not to coincide with each other, but to have an increased or decreased offset.

Further, the heat insulation grooves 188 along one of the plurality of lines may be provided to partially overlap the heat insulation grooves 188 along another line adjacent thereto in the second direction W2. Due to the configuration of the heat insulation grooves 188, an entire region of the printing medium moving in the first direction W1 may be influenced by the heat insulation grooves 188.

If the heat insulation grooves 188 are arranged to be biased to a certain section or not to be distributed to the certain section, then overheating may occur such that a fixing defect at a certain region of the printing medium may occur. However, this defect may be minimized and/or prevented by the heat insulation grooves 188.

If each of the heat insulation grooves 188 has a large cross-sectional area, the fixing belt 120 may be pressed by the rotational member 110 and inserted into the heat insulation grooves 188, and thus increasing a difficulty to form the fixing nip N. That is, in order for the nip forming part 187 to support the fixing belt 120 and also to provide an insulation effect together with the heat insulation grooves 188 on the same surface, the heat insulation grooves 188 may be uniformly and densely arranged.

In other words, each of the heat insulation grooves 188 has a first surface area Al of a size and dimension that prevents or minimizes the fixing belt 120 from being pressed by the rotational member 110 and thus inserted into the heat insulation grooves 188. The first surface area may be individually applied according to a thickness of the fixing belt 120, a pressure of the rotational member 110, or the like.

A cross-section of each of the heat insulation grooves 188 may have one of a circular shape, a polygonal shape, and another polygonal shape of which vertices are rounded. In the drawings, each of the heat insulation grooves 188 has the circular shape, but the present general inventive concept is not limited thereto.

Figure 7:
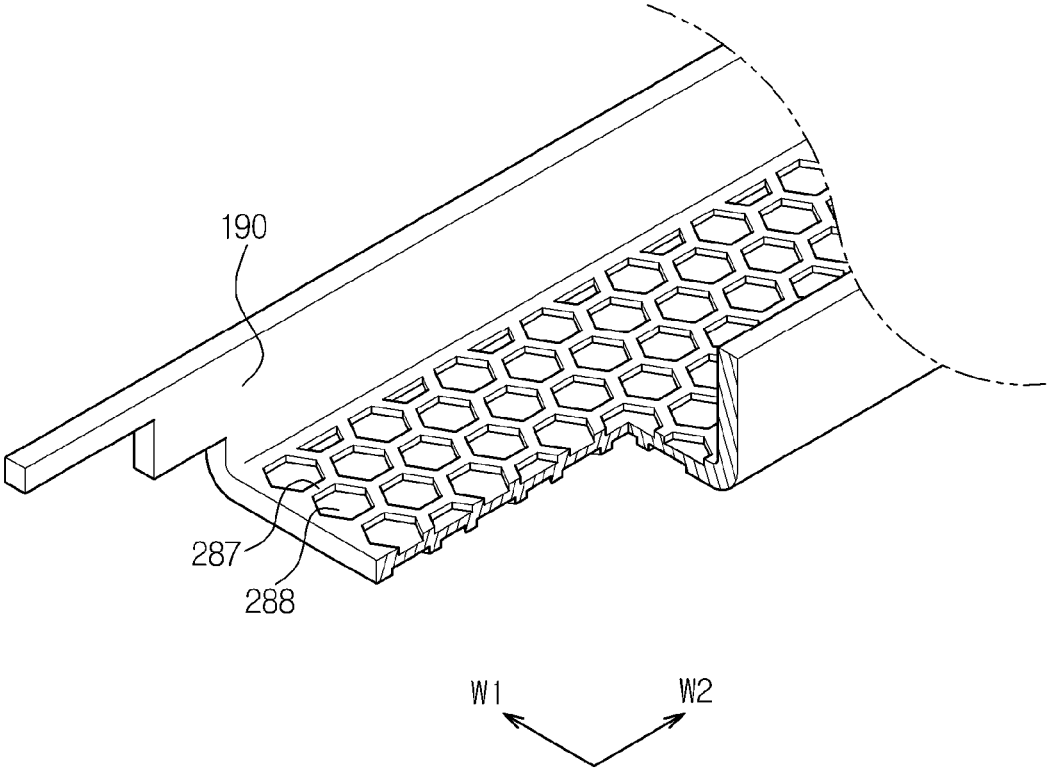
FIG. 7 is a partially cross-sectional view of the nip forming unit in accordance with another exemplary embodiment of the present general inventive concept.

In another exemplary embodiment, the heat insulation grooves 188 may be formed in the nip forming part 187 to be covered, and may have honeycomb shapes. As illustrated in FIG. 7, the nip forming part 287 may form a grid type frame having honeycomb shapes, and each of the heat insulation grooves 288 may form a space defined between the grids.

Referring back to FIGS. 4 and 5, the guide part 190 serves to guide the pressure member 140 provided in a length direction of the supporting member 182, and may be formed of the same material as the supporting member 182, and also may be extended from the supporting member 182 so as to perform a guiding function.

Further, the guide part 190 may also have the heat insulation grooves 188 so as to block the heat transferred to a side surface of the pressure member 140.

The subsidiary supporting member 200 is provided between the supporting member 182 and the fixing belt 120 so as to enhance a heat insulation effect of the supporting member 182 and also to reduce friction. For example, the subsidiary supporting member 200 may include a surface finish to reduce friction between the fixing belt and the subsidiary supporting member 200.

The plurality of heat insulation grooves 188 may be formed in the first surface 182*a* so as to be in contact with an inner surface of the subsidiary supporting member 200.

Further, the subsidiary supporting member 200 may have a reversed arch shape so as to cover a lower portion of the nip forming unit 180, or may have the same shape as the supporting member 182 so as to cover only a lower surface of the supporting member 182.

According to the image fixing device and the image forming apparatus having the same, it is possible to enhance the heating performance of the fixing belt through the heat insulation structure provided therein and also to improve the fixedness.

Although a few embodiments of the present general inventive concept have been shown and described, it will be appreciated by those skilled in the art that changes may be made in these embodiments without departing from the principles and spirit of the general inventive concept, the scope of which is defined in the claims and their equivalents.

What is claimed is:

1. An image fixing device comprising:

a fixing belt heated by a heat source and disposed to be rotatable;

a rotational member disposed to be opposite to the fixing belt and to press a printing medium to the fixing belt; and a supporting member to support an inner circumferential surface of the fixing belt so as to form a fixing nip between the fixing belt and the rotational member, the supporting member comprising:

a first surface which is formed toward the rotational member, a second surface which is opposite to the first surface, and a first plurality of heat insulation grooves formed in the second surface so as to reduce thermal conductivity of the supporting member.

2. The image fixing device according to claim 1, wherein the supporting member comprises:

a second plurality of heat insulation grooves formed in the first surface.

3. The image fixing device according to claim 2, wherein the second plurality of heat insulation grooves are formed in the first surface so as to be in contact with the inner circumferential surface of the fixing belt.

4. The image fixing device according to claim 2, further comprising a pressure member disposed in the fixing belt so as to press the second surface, wherein the plurality of heat insulation grooves are formed in the second surface so as to be in contact with the pressure member.

5. The image fixing device according to claim 2, further comprising a subsidiary supporting member provided between the supporting member and the fixing belt so as to reduce friction of the supporting member.

6. The image fixing device according to claim 5, wherein the plurality of heat insulation grooves are formed in the first surface so as to be in contact with an inner surface of the subsidiary supporting member.

7. The image fixing device according to claim 1, wherein the plurality of heat insulation grooves are provided so as to reduce the thermal conductivity from the fixing belt to the pressure member.

8. The image fixing device according to claim 1, wherein the first plurality of heat insulation grooves comprise:

a lower heat insulation groove formed in the first surface; and an upper heat insulation groove formed in the second surface.

9. The image fixing device according to claim 8, wherein the upper heat insulation groove and the lower heat insulation groove are disposed to be offset from each other.

10. The image fixing device according to claim 1, wherein each of the plurality of heat insulation grooves has one of a circular shape and a polygonal shape.

11. An image fixing device comprising:

a heat source configured to generate heat;

a fixing belt heated by the heat source and disposed to be rotatable;

a rotational member disposed to be opposite to the fixing belt and to press a printing medium to the fixing belt; and a supporting member to support an inner circumferential surface of the fixing belt so as to form a fixing nip between the fixing belt and the rotational member and having a plurality of heat insulation grooves formed in a surface thereof so as to reduce thermal conductivity of the supporting member, wherein the supporting member is disposed in a first direction which is a movement direction of the printing medium and a second direction which is perpendicular to the first direction, and wherein the heat insulation grooves are arranged in a plurality of lines in the second direction, wherein the heat insulation grooves in one of the plurality of lines are provided to partially overlap the heat insulation grooves in another adjacent line in the second direction.

12. The image fixing device according to claim 11, wherein the heat insulation grooves in one of the plurality of lines are disposed to be offset from the heat insulation grooves in another adjacent line.

13. An image fixing device comprising:

a heat source configured to generate heat;

a fixing belt heated by the heat source and disposed to be rotatable;

a rotational member disposed to be opposite to the fixing belt and to press a printing medium to the fixing belt; and a supporting member to support an inner circumferential surface of the fixing belt so as to form a fixing nip between the fixing belt and the rotational member and having a plurality of heat insulation grooves formed in a surface thereof so as to reduce thermal conductivity of the supporting member, wherein the supporting member further comprises a guide part which is bent from front and rear ends thereof with respect to a movement direction of the printing medium so as to guide the pressure member.

14. An image forming apparatus comprising an image fixing device which is configured to apply heat and pressure to a printing medium passing through a fixing nip and thus to fix a non-fixed image on the printing medium, the image fixing device comprising:

a heat source configured to generate heat;

a fixing belt heated by the heat source and disposed to be in contact with a surface of the printing medium having a non-fixed image and to transfer heat thereto;

a rotational member disposed to be in pressure contact with an outer circumferential surface of the fixing belt;

a pressure member disposed in the fixing belt to press the fixing belt to the rotational member; and a supporting member pressed by the pressure member so as to form the fixing nip between the fixing belt and the rotational member and to support an inner circumferential surface of the fixing belt, the supporting member comprising:

a supporting surface to support the pressure member and the inner circumferential surface of the fixing belt; and a plurality of heat insulation grooves which are formed to be relatively more concave than the supporting surface and are formed on a portion of the supporting surface facing the pressure member, wherein the supporting surface comprises:

a first surface supporting the inner circumferential surface of fixing belt; and a second surface pressed by the pressure member, and wherein the plurality of heat insulation grooves are formed in at least one of the first and second surfaces.

15. The image forming apparatus according to claim 14, wherein the plurality of heat insulation grooves are alternately disposed so that at least one of the plurality of heat insulation grooves corresponds to a movement direction of the printing medium.

16. The image forming apparatus according to claim 14, wherein the plurality of heat insulation grooves comprise:

a lower heat insulation groove formed in the first surface; and an upper heat insulation groove formed in the second surface.

17. The image forming apparatus according to claim 14, wherein the plurality of heat insulation grooves are uniformly distributed in the supporting surface.

18. The image forming apparatus according to claim 14, wherein the plurality of heat insulation grooves have a first surface area or less, such that the fixing belt is prevented from being pressed by the rotational member and thus inserted into the heat insulation grooves.

19. An image fixing device comprising:

a fixing belt disposed to be rotatable;

a rotational member disposed to pressure an outer circumferential surface of the fixing belt;

a supporting member to support an inner circumferential surface of the fixing belt so as to form a fixing nip between the fixing belt and the rotational member; and a pressure member to press the supporting member to the fixing belt, wherein the supporting member comprises:

a base part disposed in the fixing belt in a length direction of the fixing belt; and a plate insulation part to reduce thermal conductivity of the supporting member and comprising a nip forming part extending and protruding from the base part so as to form the fixing nip, and a plurality of heat insulation grooves formed in the nip forming part to receive air.

* * * * *